US011027939B2

(12) United States Patent
Shin et al.

(10) Patent No.: US 11,027,939 B2
(45) Date of Patent: Jun. 8, 2021

(54) SHEET FOLDING DEVICE

(71) Applicant: HEWLETT-PACKARD DEVELOPMENT COMPANY, L.P., Spring, TX (US)

(72) Inventors: Jae Hyun Shin, Pangyo (KR); Jung Kyu Park, Pangyo (KR); Eiji Fukasawa, Pangyo (KR); Soo Bok Lee, Pangyo (KR); DongSun Jung, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/631,085

(22) PCT Filed: Mar. 12, 2018

(86) PCT No.: PCT/KR2018/002867
§ 371 (c)(1),
(2) Date: Jan. 14, 2020

(87) PCT Pub. No.: WO2019/045207
PCT Pub. Date: Mar. 7, 2019

(65) Prior Publication Data

US 2020/0148499 A1 May 14, 2020

(30) Foreign Application Priority Data

Aug. 28, 2017 (KR) ..... 10-2017-0108849

(51) Int. Cl.
*B65H 45/18* (2006.01)
*B65H 45/16* (2006.01)

(52) U.S. Cl.
CPC ..... *B65H 45/18* (2013.01); *B65H 45/16* (2013.01); *B65H 2801/27* (2013.01)

(58) Field of Classification Search
CPC ..... B65H 45/18; B65H 37/06; B65H 29/125; B65H 45/04; B65H 29/52; B65H 29/58; B65H 45/16
See application file for complete search history.

(56) References Cited

U.S. PATENT DOCUMENTS 4,419,088 A * 12/1983 Nemec ..... B65H 45/18 493/444
6,276,677 B1 8/2001 Hommochi et al.
(Continued)

FOREIGN PATENT DOCUMENTS

DE 19843872 A1 * 3/2000 ..... B65H 45/18
JP 2011-178503 A 9/2011

*Primary Examiner* — Patrick H Mackey
(74) *Attorney, Agent, or Firm* — Staas & Halsey LLP

(57) ABSTRACT

A sheet folding device includes a folding path, a folding roller including at least two rollers that engage with each other to form a folding nip and rotate, a folding blade to be movable to an insertion location at which at least one sheet of paper on the folding path is pushed into the folding nip, and to a retreat location escaping from the folding path, a guide member to move along with the folding blade, located at at least one side of the folding blade, and to push the paper towards the folding roller when the folding blade is moved to the insertion location and an elastic member to apply elasticity to the guide member towards the folding roller.

13 Claims, 12 Drawing Sheets

(56) References Cited

U.S. PATENT DOCUMENTS

| | | | | |
|---|---|---|---|---|
| 7,121,993 | B2 * | 10/2006 | Matsumoto | B65H 45/18 493/434 |
| 8,002,256 | B2 * | 8/2011 | Sasahara | G03G 15/6541 270/45 |
| 8,851,464 | B2 * | 10/2014 | Shimizu | G03G 15/6544 270/39.08 |
| 2003/0040414 | A1 | 2/2003 | Tamura et al. | |
| 2004/0155394 | A1 | 8/2004 | Garner et al. | |
| 2004/0254054 | A1 | 12/2004 | Suzuki et al. | |
| 2011/0319244 | A1 * | 12/2011 | Toyoizumi | B65H 45/18 493/416 |
| 2014/0171285 | A1 * | 6/2014 | Farlotti | B65H 45/18 493/444 |
| 2020/0087100 | A1 * | 3/2020 | Fukasawa | B65H 29/58 |

* cited by examiner

[Fig. 1]
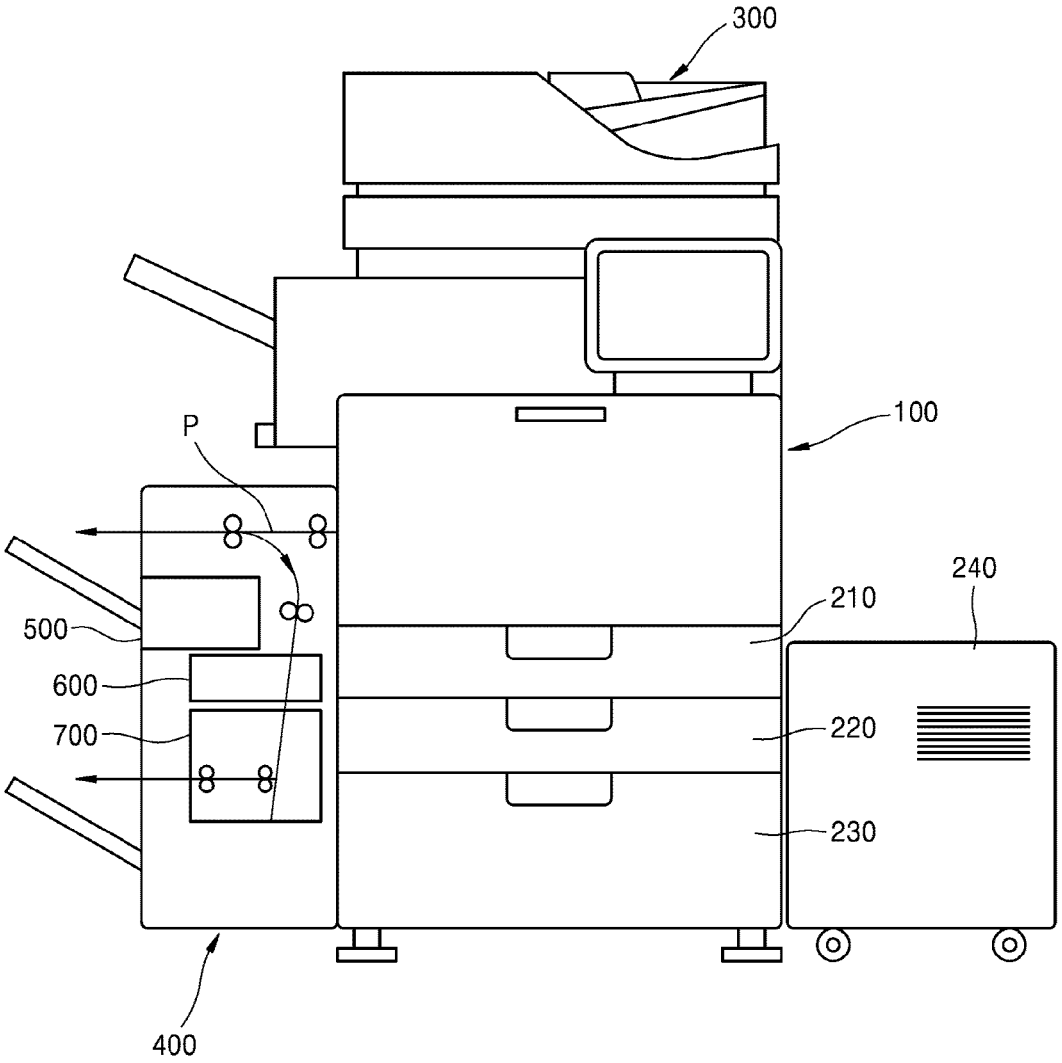

[Fig. 2]
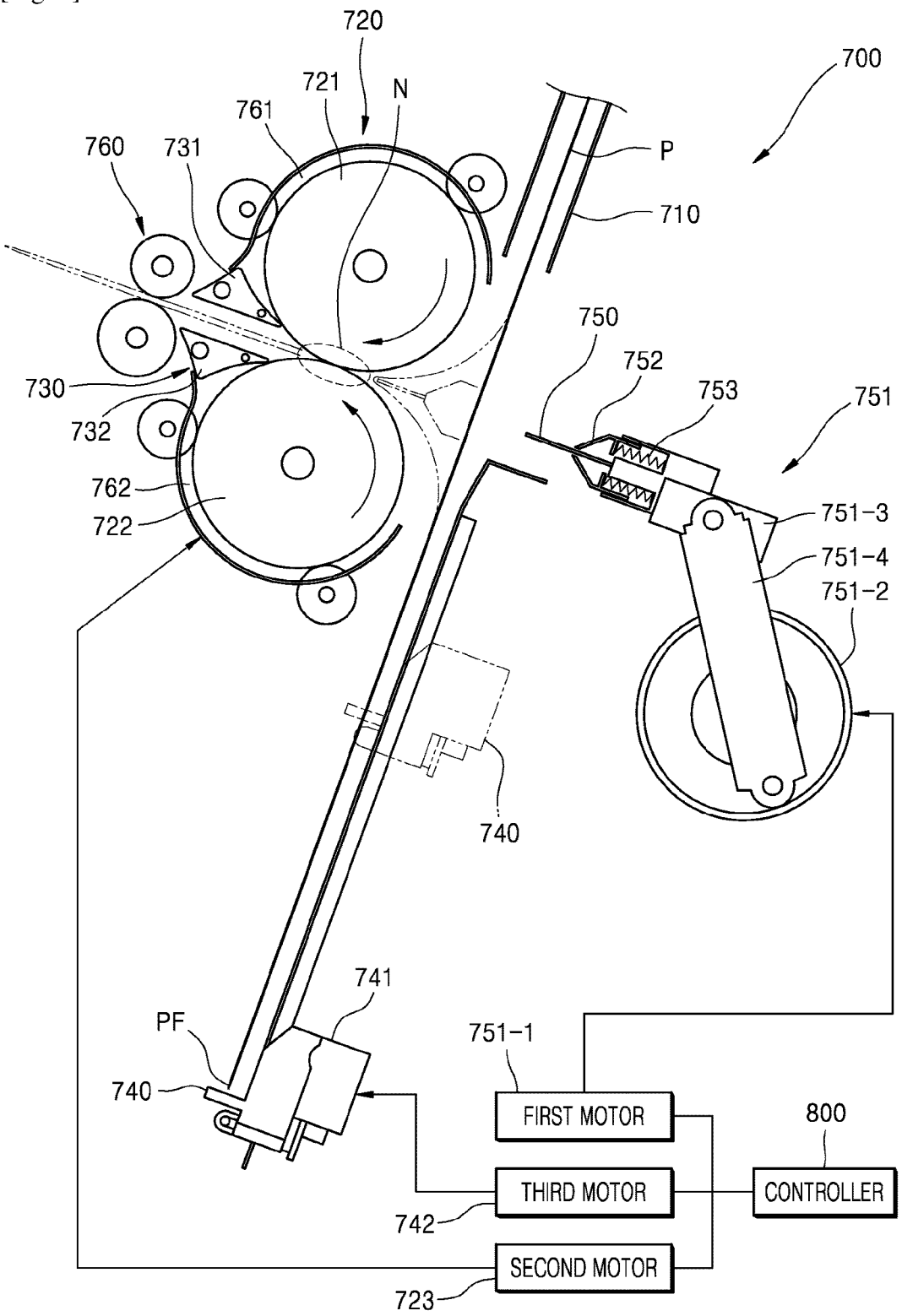

[Fig. 3]
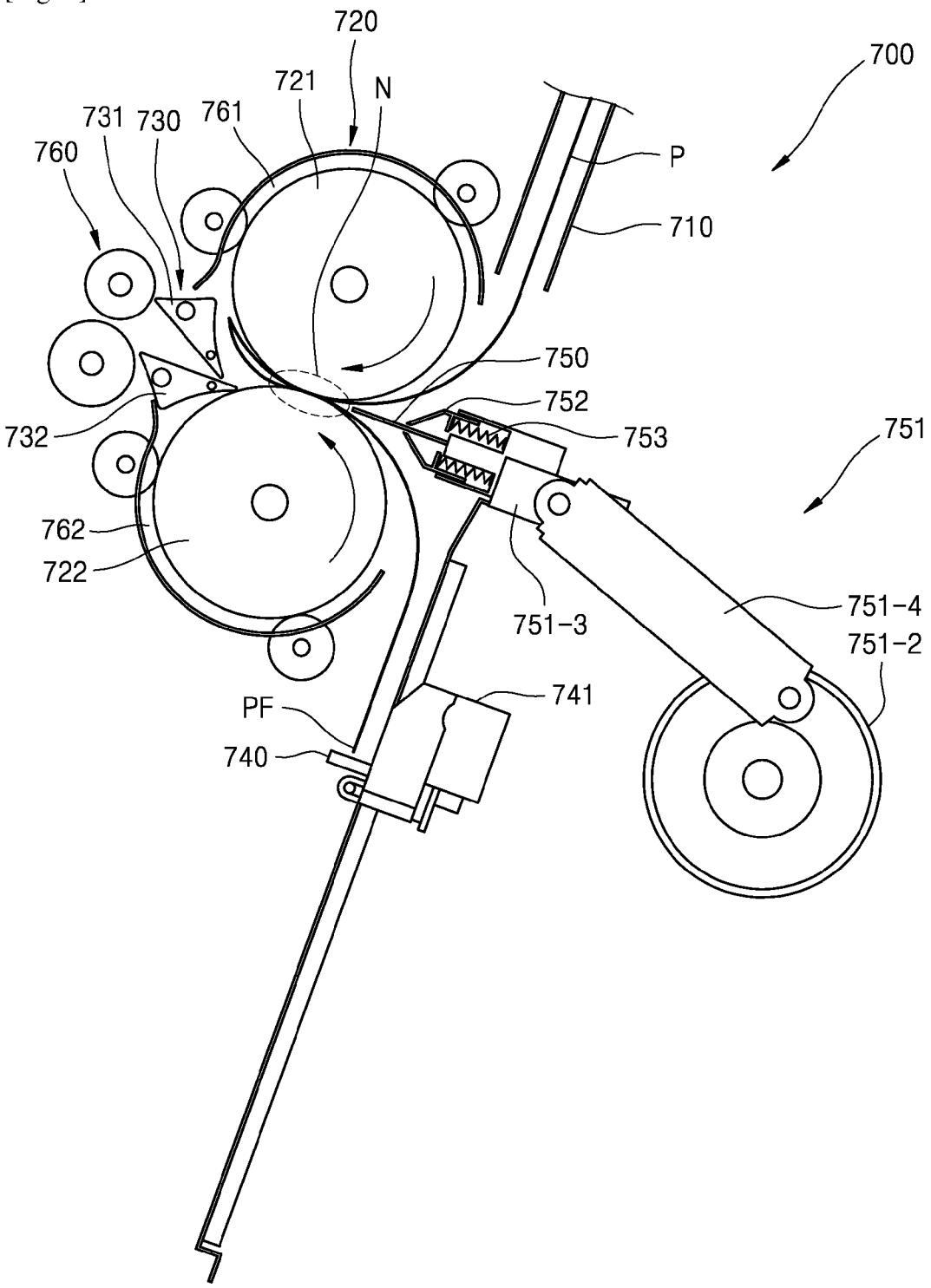

[Fig. 4]
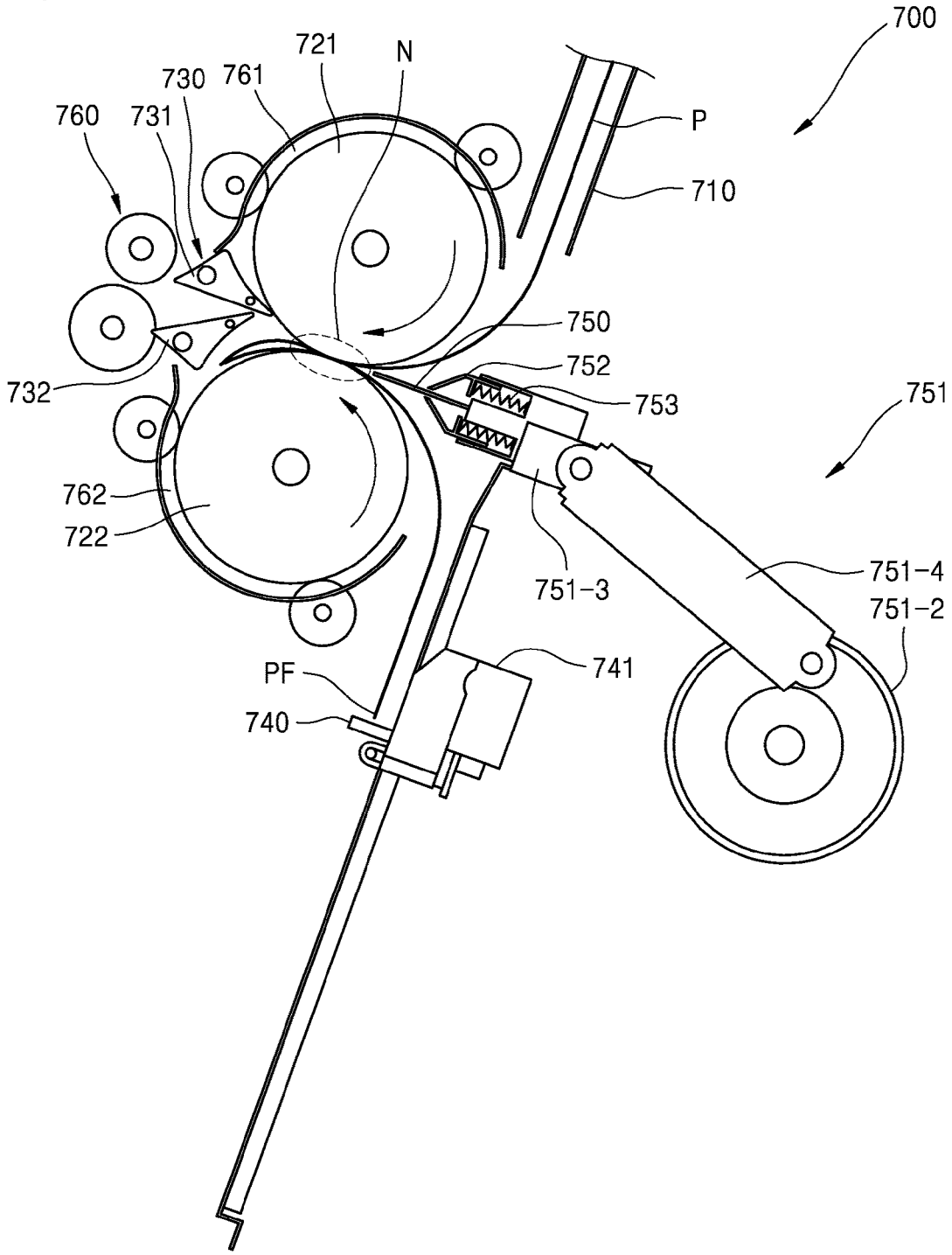

[Fig. 5]
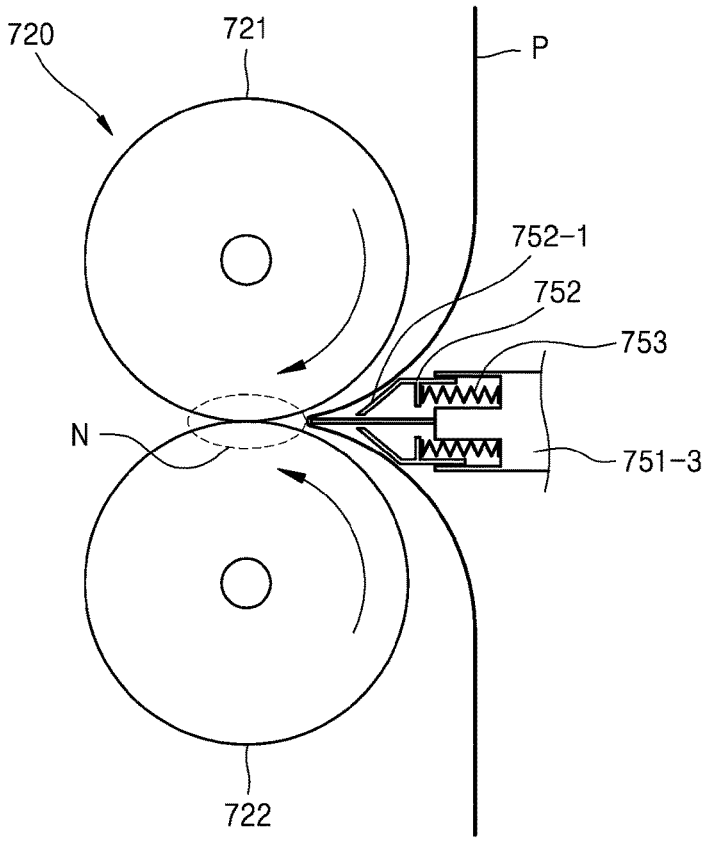
[Fig. 6]
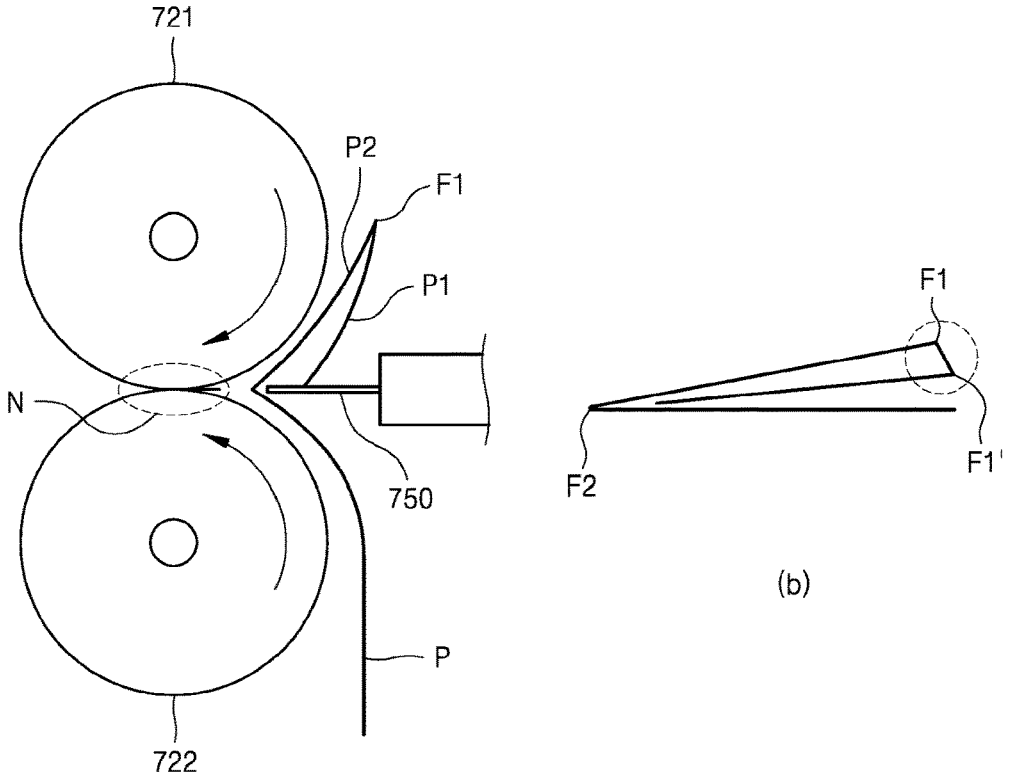

[Fig. 7]
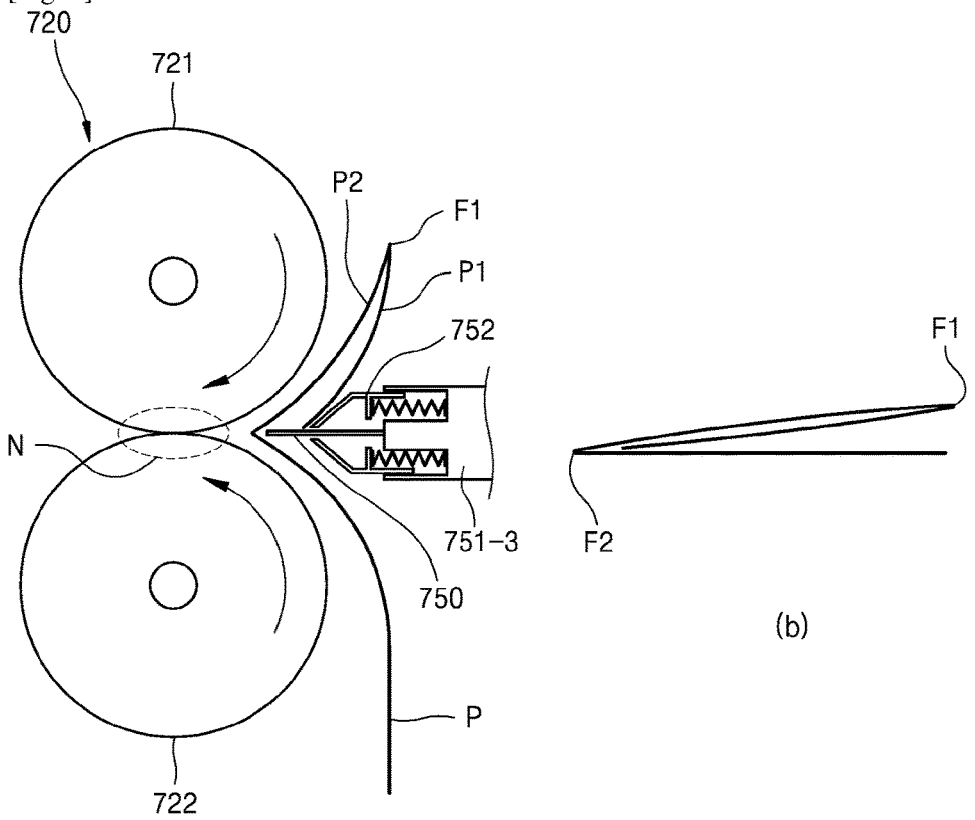
(a)
(b)
[Fig. 8]
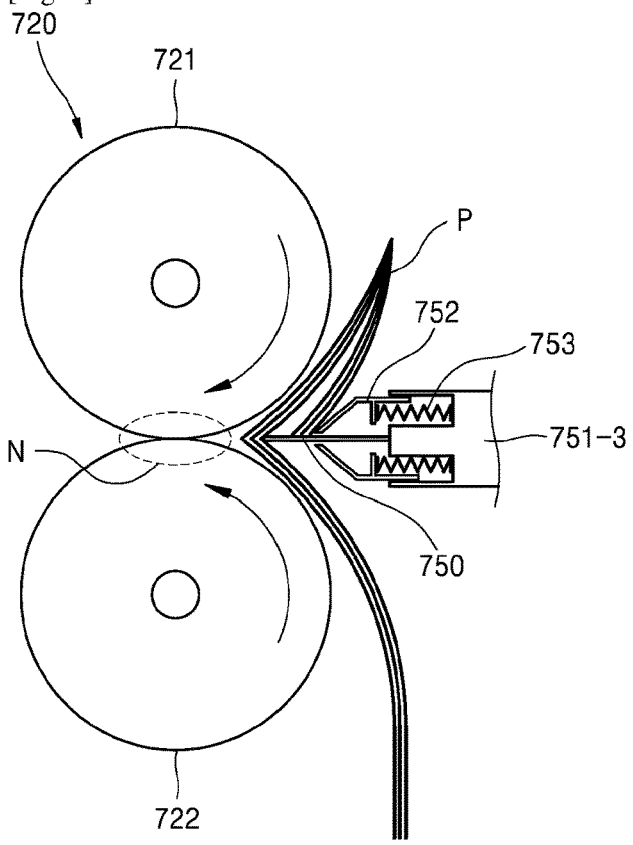

[Fig. 9]
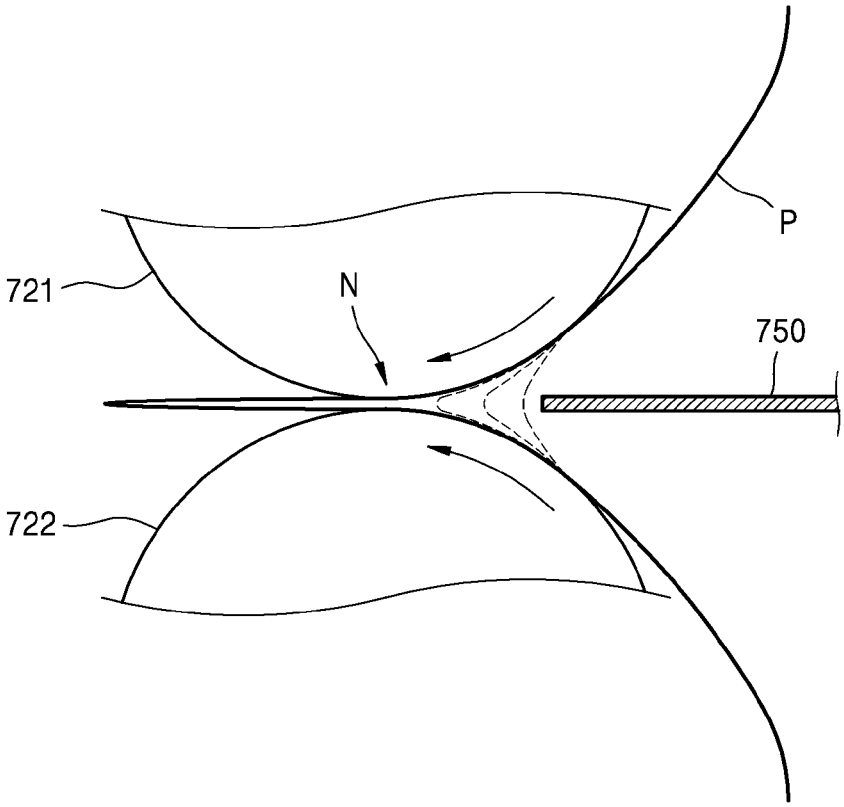
[Fig. 10]
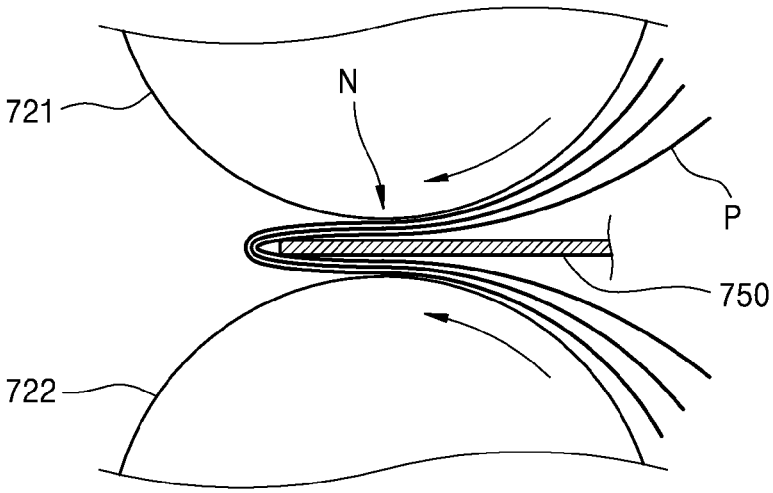

[Fig. 11]
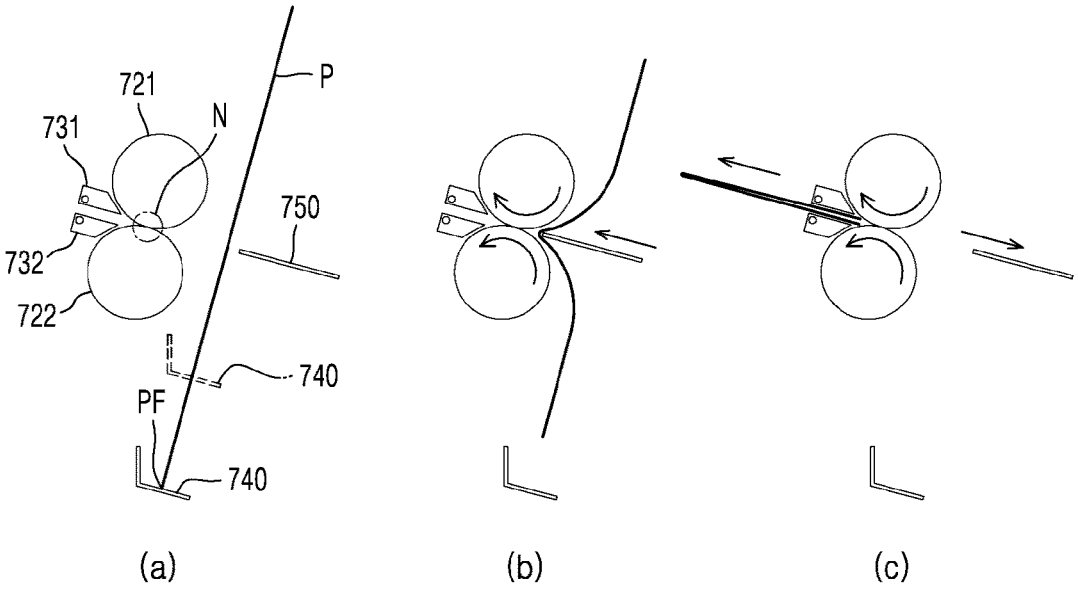

[Fig. 12]
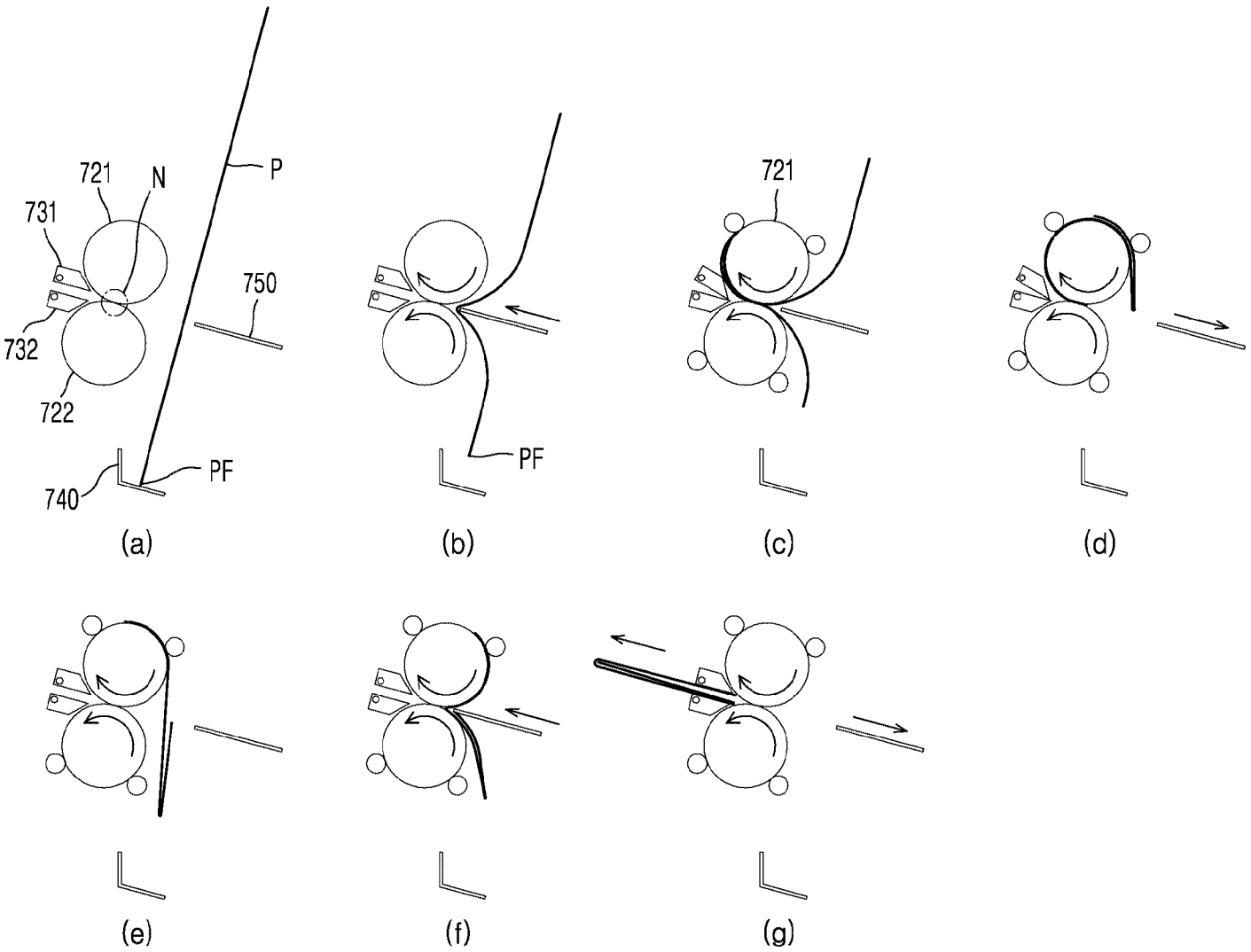

[Fig. 13]
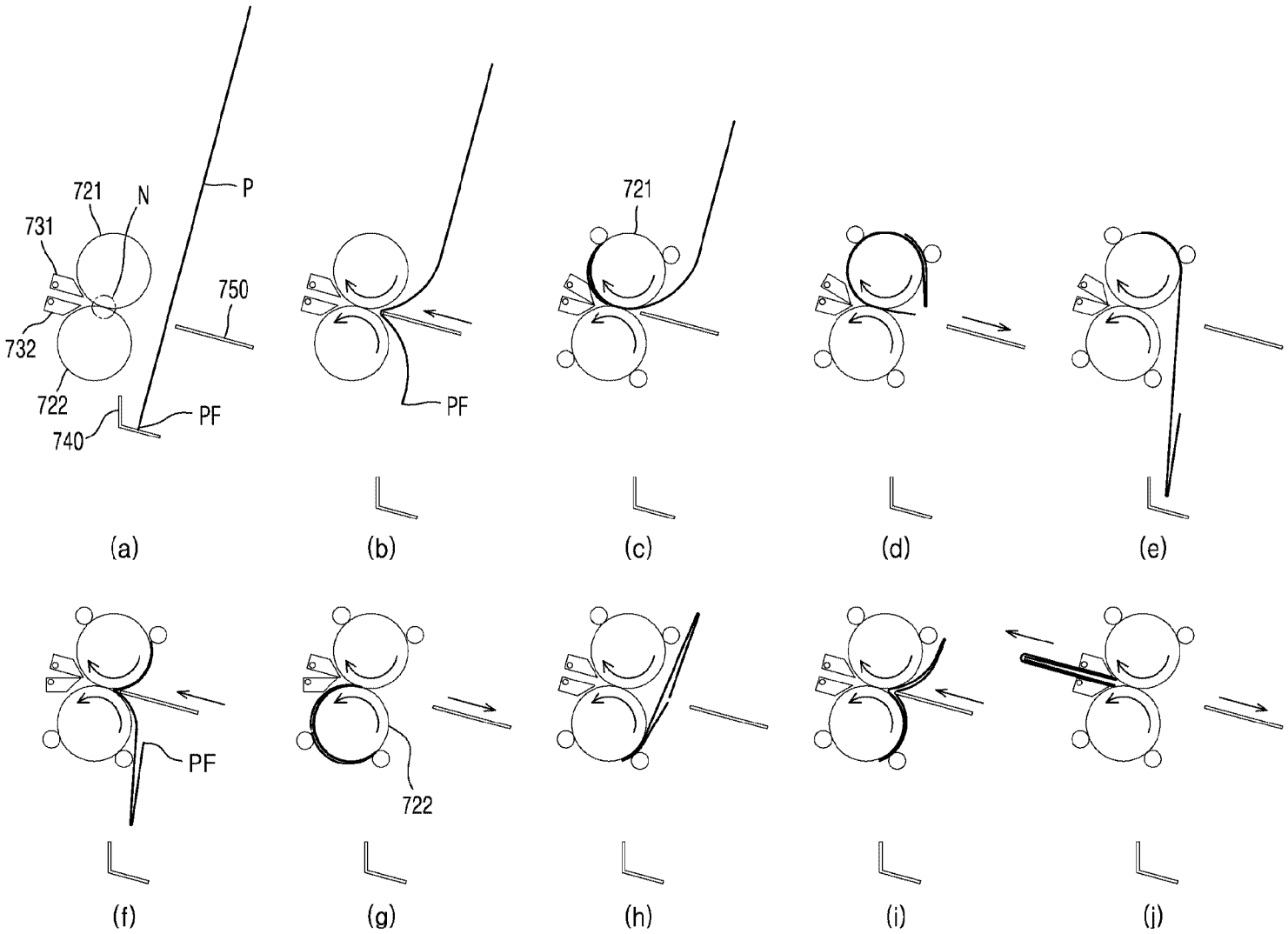

[Fig. 14]
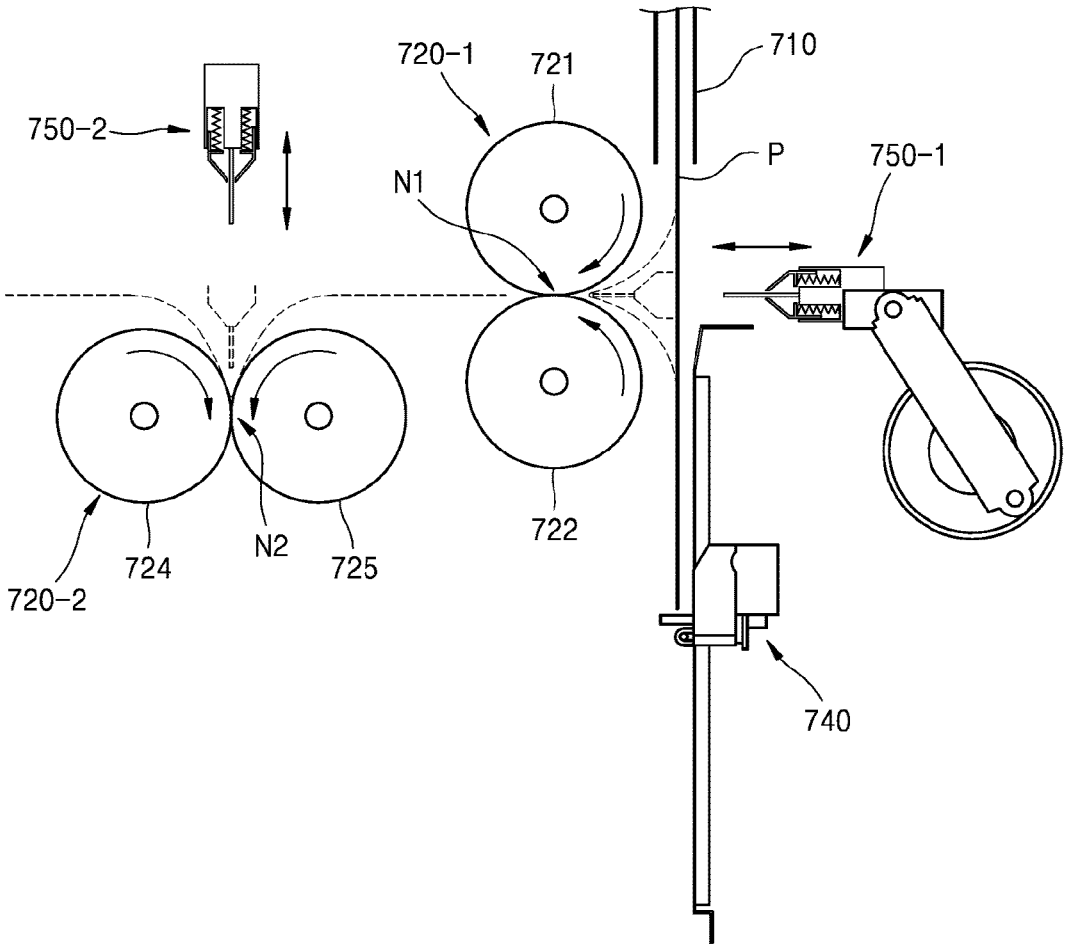

[Fig. 15]
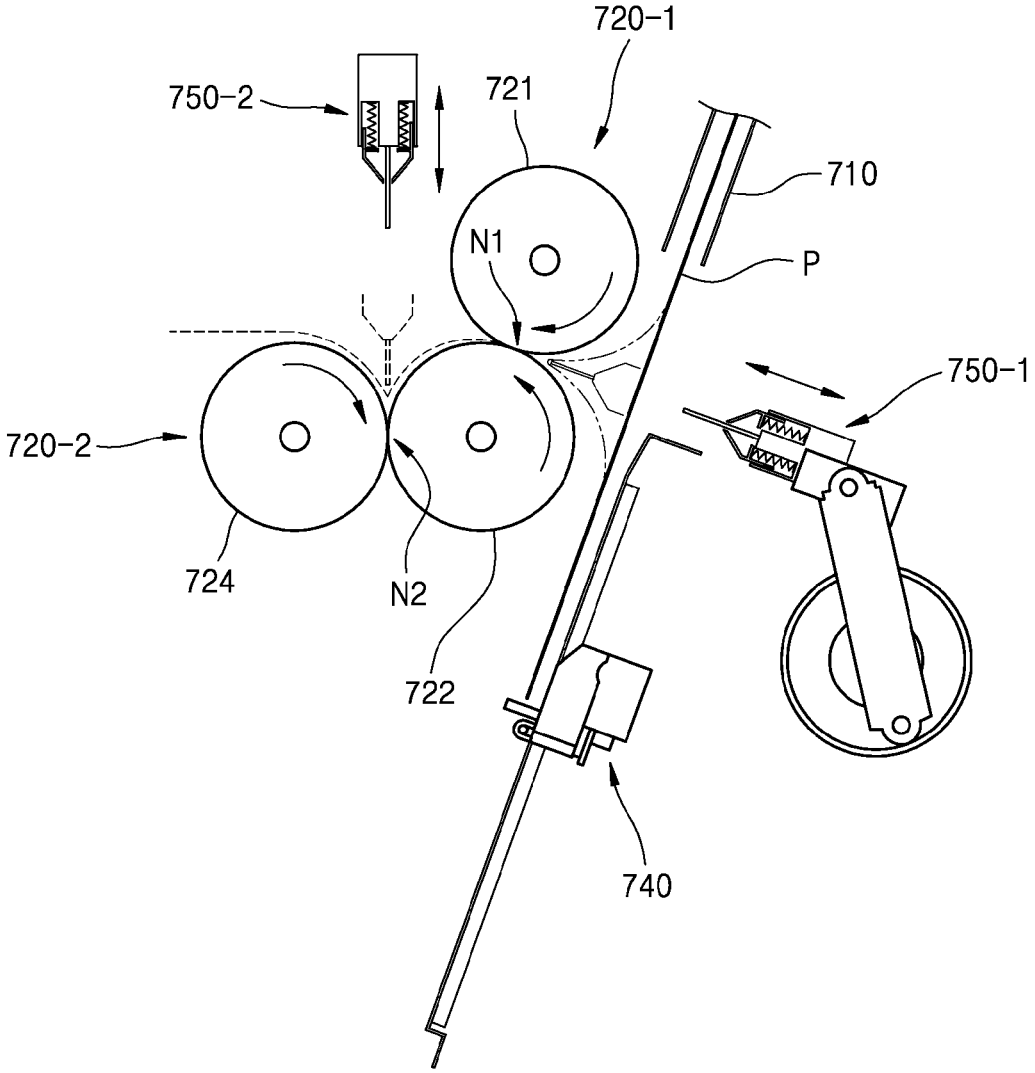

SHEET FOLDING DEVICE

CROSS-REFERENCE TO RELATED APPLICATIONS

This application is filed under 35 U.S.C. § 371 as a PCT national phase of PCT International Application No. PCT/KR2018/002867, filed on Mar. 12, 2018, in the Korean Intellectual Property Office, which claims the priority benefit of Korean Patent Application No. 10-2017-0108849, filed on Aug. 28, 2017 in the Korean Intellectual Property Office, the contents of the PCT International Application and the Korean Patent Application are incorporated by reference herein in their entirety.

BACKGROUND ART

A sheet folding device folds a medium (hereinafter, referred to as 'paper') on a sheet in various forms. The sheet folding device may be included in a finisher with respect to paper discharged from a copier, a printer, or the like, and may be a stand-alone device.

A sheet folding device uses a folding blade to push a portion of paper, which is to be folded and between a front-end portion and a rear-end portion of the paper, into a pair of rollers rotating engaged with each other, thereby folding the paper. The sheet folding device may fold a single sheet or multiple sheets of paper. Also, the sheet folding device may have a structure for folding paper twice or more.

DESCRIPTION OF DRAWINGS

These and/or other aspects will become apparent and more readily appreciated from the following description of the examples, taken in conjunction with the accompanying drawings in which:

FIG. 1 is a schematic structural diagram of an image forming apparatus according to an example;

FIG. 2 is a structural diagram of a sheet folding device according to an example and illustrates a state in which a folding blade is at a retreat location;

FIG. 3 illustrates a state in which a first shift member of the sheet folding device of FIG. 2 is at a first shift location;

FIG. 4 illustrates a state in which a second shift member of the sheet folding device of FIG. 2 is at a second shift location;

FIG. 5 is a detailed diagram illustrating pushing paper into a folding nip by using a folding blade;

FIG. 6 illustrates a second-folding process;

FIGS. 7 and 8 are schematic diagrams illustrating operations of a sheet folding device using a guide member;

FIG. 9 illustrates a state in which a folding blade is at a first insertion location;

FIG. 10 illustrates a state in which a folding blade is at a second insertion location;

FIG. 11 illustrates an example of a V-fold;

FIG. 12 illustrates an example of a C-fold;

FIG. 13 illustrates an example of a double gate fold;

FIG. 14 is a schematic structural diagram of a sheet folding device including two folding rollers, according to an example; and FIG. 15 is a schematic structural diagram of a sheet folding device in which three rollers form two folding nips, according to an example.

MODE FOR INVENTION

Hereinafter, examples of a sheet folding device and an image forming apparatus using the same will be described with reference to the accompanying drawings. In the drawings, like reference numerals denote like elements, and a size or thickness of each component may be exaggerated for clarity of description. As used herein, the term "and/or" includes any and all combinations of one or more of the associated listed items. Expressions such as "at least one of", when preceding a list of elements, modify the entire list of elements and do not modify the individual elements of the list.

FIG. 1 is a schematic structural diagram of an image forming apparatus according to an example. Referring to FIG. 1, the image forming apparatus includes a printer 100 and a finisher 400. The printer 100 prints an image on a sheet-type medium (hereinafter, referred to as 'paper') provided from a paper feeder. The paper feeder may be, for example, a main cassette feeder 210 installed under the printer 100, a secondary cassette feeder 220 installed under the main cassette feeder 210, a high capacity feeder 230 installed under the main cassette feeder 210 or under the secondary cassette feeder 220, a high capacity feeder 240 installed at a side of the printer 100, or the like. Although not illustrated, the paper feeder may be a multi-purposetray (MPT).

The printer 100 may print an image on paper P by using various printing methods such as an electrophotography method, an inkjet method, a thermal transfer method, and a thermal sublimation method. For example, the image forming apparatus according to an example embodiment prints a color image on the paper P by using an electrophotography method. The above printing methods are well known in the art, and thus, a detailed description thereof will be omitted herein.

The image forming apparatus may further include a scanner 300 for reading an image recorded on a document. The scanner 300 may have any of various structures such as a flatbed mechanism where a document is at a fixed position and an image is read while a reading member is moved, a document feeding mechanism where a reading member is at a fixed position and a document is fed, and a combination structure thereof. The principle and structure of the scanner 300 are well known in the art, and thus, a detailed description thereof will be omitted herein.

The finisher 400 may include a sheet folding device 700 for folding, one or more times, the paper P discharged from the printer 100. The finisher 400 may further include an alignment device 500 for aligning the paper P discharged from the printer 100. The alignment device 500 may have a structure for stapling the paper P at an end portion thereof or punching a hole in an end portion of the paper P. The finisher 400 may further include a middle stapler 600 for stapling the paper P at a center portion thereof. Structures of the alignment device 500 and the middle stapler 600 are well known in the art, and thus, a detailed description thereof will be omitted herein.

Hereinafter, examples of the sheet folding device 700 will be described in detail.

FIG. 2 is a structural diagram of the sheet folding device 700 according to an example and illustrates a state in which a folding blade 750 is at a retreat location. FIG. 2 illustrates a folding path 710 and a folding roller 720. The folding roller 720 is on the folding path 710. The folding roller 720 includes first and second rollers 721 and 722 engaging with each other to form a folding nip N and rotating. The first roller 721 is at an upstream side of the folding path 710, and the second roller 722 is at a downstream side thereof. A second motor 723 rotates the folding roller 720. A controller 800 controls the sheet folding device 700. The controller 800 may rotate the folding roller 720 by driving the second motor 723.

The folding blade 750, which is moved to an insertion location (a dashed line of FIG. 2) for pushing the paper P on the folding path 710 into the folding nip N, and is moved to a retreat location (a solid line of FIG. 2) for escaping from the folding path 710, is positioned at an entrance of the folding nip N. The folding blade 750 pushes a portion of the paper P, which is to be folded and between a front end and a rear end of the paper P, into the folding nip N. The folding blade 750 is moved to the insertion and retreat locations by, for example, a folding blade driver 751. The folding blade driver 751 may have various structures. According to an example, the folding blade driver 751 may have a slider crank structure. The folding blade driver 751 includes a rotating member 751-2 that is rotated by a first motor 751-1, a slider 751-3 that is linearly movable, and a crank 751-4 that connects the rotating member 751-2 to the slider 751-3. The folding blade 750 is installed on the slider 751-3. The controller 800 may drive the first motor 751-1 and thus may move the folding blade 750 to the insertion location and the retreat location.

Although not illustrated, the folding blade driver 751 may include the slider 751-3 on which the folding blade 750 is installed, and a linear motor (not illustrated) driving the slider 751-3. Referring to FIG. 2, the folding blade 750 is linearly moved to the insertion location and the retreat location. However, the scope of the disclosure is not limited thereto. The folding blade 750 may rotate to the insertion location and the retreat location.

A location determination member 740 may be moved to an alignment location (a solid line of FIG. 2) so as to align the paper P on the folding path 710 by supporting a front end PF of the paper P, and moved to a folding location (a dashed line of FIG. 2) so as to match a folding line location of the paper P with a location corresponding to the folding nip N. The front end PF of the paper P fed along the folding path 710 is supported by the location determination member 740 that is at the alignment location. The location determination member 740 is moved to the alignment location and the folding location by an escalating member 741. The folding location at least includes an initial folding location of the paper P. The folding location may include a location after folding is performed twice. A location of the location determination member 740 may be detected by a location detection sensor (not illustrated). The escalating member 741 may include a third motor 742. The third motor 742 may be, for example, a linear motor. The third motor 742 may be a rotation motor. In this case, the escalating member 741 may be realized by any of various structures such as a combination of a rotation motor and a linear movement mechanism, a combination of a rotation motor and a rotary belt, and a combination of a rotation motor and a chain.

By the above structure, the paper P may be folded once. For example, one sheet or multiple sheets of paper P discharged from the printer 100 is fed along the folding path 710, and as indicated by a solid line of FIG. 2, the front end PF of the paper P is supported by the location determination member 740 that is at the alignment location. As indicated by a dashed line of FIG. 2, the location determination member 740 is moved to the folding location and matches a folding line location of the paper P with the location corresponding to the folding nip N. As the folding blade 750 is moved to the insertion location, the folding blade 750 pushes the center portion of the paper P into the folding nip N. The paper P is folded once while being pushed into the folding nip N and is pushed out through an exit of the folding nip N. The folded paper P is externally discharged by a discharge roller 760. Thus, a V-fold may be performed. The folding line location may be determined by the location determination member 740.

The sheet folding device 700 according to an example embodiment may perform folding two or more times by using one folding roller 720. To this end, the sheet folding device 700 may include a guide path for guiding the paper P having passed through the folding nip N to the folding path 710 again and returning the paper P to the entrance of the folding nip N, and a shift member 730 for selectively guiding the paper P to the discharge roller 760 and the guide path, the shift member 730 being located at the exit of the folding nip N.

The guide path may be provided around at least one of the first roller 721 and the second roller 722. In an example embodiment, the guide path includes a first guide path 761 and a second guide path 762 respectively provided around the first roller 721 and the second roller 722.

The shift member 730 may include a first shift member 731 for selectively guiding the paper P to the first guide path 761, and a second shift member 732 for selectively guiding the paper P to the second guide path 762. Although not illustrated, an actuator for driving the first and second shift members 731 and 732 may be provided. The actuator may be, for example, a solenoid actuator.

Although not illustrated, a first sensor and a second sensor for detecting the paper P may be respectively arranged on the first guide path 761 and the second guide path 762. The first and second sensors may provide a reference for determining second, third, or subsequent folding timing, that is, driving timing of the folding blade 750. Although not denoted by reference numerals, driven rollers respectively arranged around the first and second rollers 721 and 722 along the first and second guide paths 761 and 762 engage with the first and second rollers 721 and 722 and feed the paper P along the first and second guide paths 761 and 762. In an example embodiment, the first roller 721 forms a guide at one side of the first guide path 761, and the second roller 722 forms a guide at one side of the second guide path 762. That is, the paper P having passed through the folding nip N is fed along the first and second guide paths 761 and 762 in a direction winding around the first and second rollers 721 and 722 and is returned in a direction toward the entrance of the folding nip N.

FIGS. 3 and 4 are structural diagrams of the sheet folding device 700 according to an example. FIG. 3 illustrates a state in which the first shift member 731 is at a first shift location. FIG. 4 illustrates a state in which the second shift member 732 is at a second shift location.

Referring to FIG. 2, the first and second shift members 731 and 732 are at discharge locations for guiding the paper P to the discharge roller 760. Referring to FIG. 3, the first shift member 731 is at the first shift location. The paper P discharged from the folding nip N is guided to the first guide path 761 by the first shift member 731. Referring to FIG. 4, the second shift member 732 is at the second shift location. The paper P discharged from the folding nip N is guided to the second guide path 762 by the second shift member 732.

Folding may be performed twice by returning the paper P folded once to the entrance of the folding nip N via the first guide path 761 or the second guide path 762 and pushing the paper P into the folding nip N by using the folding blade 750 again. A simple 4-fold folding may be performed by once again folding a center portion of the paper P that has already been folded once. Also, a C-fold or a Z-fold, which is a 3-fold folding, may be performed by performing folding twice by using the first guide path 761 or the second guide path 762. Also, a double gate fold, a roll-fold, a W-fold, etc. may be performed by performing folding three times while allowing the paper P to sequentially pass through the first guide path 761 and the second guide path 762.

FIG. 5 is a detailed diagram illustrating pushing the paper P into the folding nip N by using the folding blade 750. FIG. 5 illustrates only the folding roller 720, the folding blade 750, guide members 752, and an elastic member 753. Referring to FIG. 5, the guide members 752 are illustrated. The guide member 752 is on at least a side of the folding blade 750. That is, the guide members 752 may be installed at a side of the folding blade 750 in a direction orthogonal to a movement direction of the folding blade 750, or may be installed at both sides thereof. In an example embodiment, the guide members 752 are installed at the sides of the folding blade 750, respectively. The guide members 752 may be moved along with the folding blade 750. For example, the guide members 752 may be installed on the slider 751-3. The guide members 752 may each include an inclined portion 752-1 inclined at an acute angle with respect to the movement direction of the folding blade 750. The inclined portion 752-1 may be, for example, a plane. The inclined portion 752-1 may be a concave or convex surface.

By the above configuration, when the folding blade 750 is moved to the insertion location, the paper P is pushed by the guide members 752 and pressed towards the folding roller 720. Thus, the paper P may be stably inserted into the folding nip N. The guide members 752 do not contact the folding roller 720 when the folding blade 750 reaches the insertion location.

The guide members 752 may be elastically biased by the elastic member 753 towards the folding roller 720. For example, the elastic member 753 may be a compressive coil spring supported between the guide members 752 and the slider 751-3. By this configuration, the elastic member 753 is pressed when multiple sheets of paper P are folded, and the guide members 752 are pushed in a direction opposite to the movement direction of the folding blade 750. In this case, the elastic member 753 provides elasticity to push the guide members 752 towards the folding roller 720. Thus, when a single sheet of paper P is folded, and when multiple sheets of paper P are folded, the paper P may be stably pressed towards the folding roller 720.

Accordingly, the paper P may be stably inserted into the folding nip N as the guide members 752 are used, and thus a folding defect, e.g., crumpling of the paper P, which is caused by a wrong insertion of the paper P into the folding nip N, may be prevented.

The guide members 752 are useful during a second folding process or subsequent folding processes. FIG. 6 illustrates the second-folding process when the guide members 752 are not used. Referring to FIG. 6, the paper P that has been already folded once, that is, the paper P on which a first folding line F1 is formed, is fed again to the folding path 710 along, e.g., the first guide path 761 provided around the first roller 721. The second folding for forming a second folding line F2 is performed as the folding blade 750 is moved to the insertion location. In this case, two portions P1 and P2, which are folded during the first folding to face each other, may not adhere to each other due to elasticity of the paper P and may be apart from each other as illustrated in FIG. 6(*a*). Then, when the paper P is pushed into the folding nip N during the second folding, the paper P may be crumpled around the first folding line F1.

As illustrated in FIG. 6(*b*), an unnecessary folding line F1' may be formed around the first folding line F1.

FIGS. 7 and 8 are schematic diagrams illustrating operations of the sheet folding device 700 using the guide members 752. According to an example embodiment, as illustrated in FIG. 7(*a*), the guide members 752 are used. When the folding blade 750 is moved to the insertion location, the portions P1 and P2 that are folded with respect to the first folding line F1 are pressed towards the folding roller 720 by the guide members 752. The portions P1 and P2 are adjacent to each other without being spaced apart from each other while being pushed by the guide members 752. Thus, portions around the first folding line F1 are not crumpled during the second folding, and as illustrated in FIG. 7(*b*), folding may be stably performed twice without the unnecessary folding line F1'. Also, by using the elastic member 753 for pressing the guide members 752 towards the folding roller 720, the portions P1 and P2 folded with respect to the first folding line F1 may be stably pressed by the guide members 752 towards the folding roller 720 even when multiple sheets of paper P are folded, as illustrated in FIG. 8.

The paper P discharged from the printer 100 is fed to the sheet folding device 700. While being fed, the paper P may be skewed. Also, the paper P may be skewed while being fed again to the folding path 710 along a guide path after the first folding. When the skewed paper P is folded, a folding line may be crooked.

In an example embodiment, the controller 800 drives the third motor 742 before second or subsequent folding is performed, and moves the location determination member 740 to the alignment location as indicated by the solid line of FIG. 2 such that an end portion of the paper P may be supported by the location determination member 740, and skew of the paper may be corrected. The alignment location may be a location where the paper P may be completely separated from rollers for feeding the paper P. In order to perform folding, the controller 800 may drive the third motor 742 to move the location determination member 740 to the folding location as indicated by the dashed line of FIG. 2 and may move a portion, where a folding line of the paper P is to be formed, to the location corresponding to the folding nip N. Then, the controller 800 drives the first motor 751-1 to move the folding blade 750 to the insertion location and pushes the portion, where the folding line of the paper P is to be formed, into the folding nip N. Creation of a crooked folding line due to the skew of the paper P may be prevented.

The folding blade 750 is in a form of a thin plate. In order to push the paper P into the folding nip N, the folding blade 750 may be inserted into the folding nip N at the insertion location. In this case, when multiple sheets of paper P are folded at the same time, sharpness of the folding line is slightly affected by a thickness of the folding blade 750, but when a single sheet of paper P is folded, the sharpness of the folding line is more affected by the thickness of the folding blade 750.

In order to form a sharp folding line, the folding blade 750 may not be inserted into the folding nip N at the insertion location. For example, as illustrated in FIG. 9, the folding blade 750 may not be inserted into the folding nip N and may be moved to a location (a first insertion location) where the paper P, which has been pushed by the folding blade 750 towards the folding nip N, may be naturally pushed into the folding nip N due to friction with the folding roller 720. By a structure for moving the folding blade 750 to the first insertion location, when a single sheet of paper P is folded, the thickness of the folding blade 750 does not affect the sharpness of the folding line, and a sharp folding line may be formed.

In the structure for moving the folding blade 750 to the first insertion location, when multiple sheets of paper P are folded at the same time, separation in which a sheet close to the folding roller 720 from among the sheets of paper P is inserted into the folding nip N first may occur, and the other sheets of paper P may be sequentially inserted into the folding nip N. When multiple sheets of paper P are folded at the same time, the sharpness of the folding line is slightly affected by the thickness of the folding blade 750. Accordingly, when multiple sheets of paper P are folded at the same time, the folding blade 750 may be moved to a location (a second insertion location) where the folding blade 750 is inserted into the folding nip N, as illustrated in FIG. 10.

The controller 800 may control the folding blade driver 751 such that the folding blade 750 is moved to the first insertion location when a single sheet of paper P is folded and the folding blade 750 is moved to the second insertion location when the multiple sheets of paper P are folded at the same time. For example, the controller 800 controls the first motor 751-1 such that the folding blade 750 is moved to the first insertion location when a single sheet of paper P is folded and the folding blade 750 is moved to the second insertion location when the multiple sheets of paper P are folded at the same time.

As another exemplary method of forming a sharp folding line, the folding blade 750 is inserted into the folding nip N at the insertion location, but when a single sheet of paper P is folded, before the folding blade 750 is inserted into the folding nip N, the paper P having pushed towards the folding nip N may be allowed to be naturally pushed into the folding nip N due to friction with the folding roller 720. Since the folding blade 750 is inserted into the folding nip N after the paper P is inserted into the folding nip N first and then the folding line is formed, a sharp folding line may be formed without being affected by the thickness of the folding blade 750. When the guide members 752 are used, the paper P is pushed by the guide members 752 towards the folding roller 720 as the folding blade 750 gets close to the folding nip N. Accordingly, the paper P may be stably inserted into the folding nip N before the folding blade 750 reaches the folding nip N.

The above exemplary method may be realized by controlling at least one of movement linear velocity of the folding blade 750 and rotation linear velocity of the folding roller 720. For example, when the movement linear velocity of the folding blade 750 is V1 and the rotation linear velocity of the folding roller 720 is V2, the controller 800 controls at least one of the folding roller 720 and the folding blade driver 751 so as to satisfy V1<V2 when a single sheet of paper P is folded. The above condition may be realized by fixing V1 and changing V2 or by changing V1 and fixing V2. Of course, both V1 and V2 may be changed.

When multiple sheets of paper P are folded at the same time, under a condition of V1<V2, separation in which a sheet close to the folding roller 720 from among the sheets of paper P is inserted into the folding nip N first may occur, and the other sheets of paper P may be sequentially inserted into the folding nip N. The separation may occur under a condition of V1=V2. In order to solve such a problem, when multiple sheets of paper P are folded at the same time, the controller 800 may control at least one of the folding roller 720 and the folding blade driver 751 to satisfy a condition of V1>V2. Such a condition may be realized by fixing V1 and changing V2 or by fixing V2 and changing V1. Of course, both V1 and V2 may be changed. Since the movement linear velocity of the folding blade 750 is higher than transfer velocity of the paper P by the folding roller 720, the folding blade 750 may be inserted into the folding nip N in a state in which the sheets of paper P are not separated. Accordingly, when multiple sheets of paper P are folded at the same time, separation may be prevented.

The controller 800 controls at least one of the first motor 751-1 and the second motor 723 so as to control a relation between V1 and V2 as described above. That is, when a single sheet of paper P is folded, the controller 800 may control at least one of the first motor 751-1 and the second motor 723 to satisfy the condition V1<V2, and when multiple sheets of paper P are folded at the same time, the controller 800 may control at least one of the first motor 751-1 and the second motor 723 to satisfy the condition V1>V2.

A structure for controlling the movement linear velocity of the folding blade 750 and the rotation linear velocity of the folding roller 720 may be rather simple compared to the above structure for controlling the insertion location of the folding blade 750. For example, in a case where the folding blade driver 751 having a slider-crank structure is used as illustrated in FIG. 2, in the structure for controlling the insertion location of the folding blade 750, when a single sheet of paper P is folded, the first motor 751-1 stops working at the first insertion location before the rotating member 751-2 rotates once and then rotates again in a reverse direction. However, in the structure for controlling the movement linear velocity of the folding blade 750 and the rotation linear velocity of the folding roller 720, the folding blade 750 may be returned to the retreat location from the insertion location as the rotating member 751-2 rotates once. According to necessity, rotation velocity of the first motor 751-1 and/or the second motor 723 may be adjusted.

Hereinafter, various examples of a paper folding method according to the above examples will be described. A V-fold will be described as an example of a 1-fold folding, a C-fold will be described as an example of a 2-fold folding, and a double gate fold will be described as an example of a 3-fold folding.

[V-Fold]

FIG. 11 illustrates an example of a V-fold. FIG. 11 illustrates the folding roller 720, the location determination member 740, the folding blade 750, and the first and second shift members 731 and 732.

As indicated by a solid line of FIG. 11(*a*), the location determination member 740 is at the alignment location. The paper P discharged from the printer 100 is fed along the folding path 710. The front end PF of one or multiple sheets of paper P is supported by the location determination member 740 that is at the alignment location, and skew is corrected.

As indicated by a dashed line of FIG. 11(*a*), the location determination member 740 is moved to the folding location. The folding location is a location where the center portion of the paper P is at the entrance of the folding nip N. That is, a distance from the folding nip N to the location determination member 740 that is at the folding location is ½ L when a length of the paper P is L. Then, the folding blade 750 is moved to the insertion location to push a ½ L point of the paper P into the folding nip N (FIG. 11(*b*)). As the paper P passes through the folding nip N, the ½ L point of the paper P is folded. The first and second shift members 731 and 732 are at the discharge locations. Therefore, the paper P folded in a form of a V is discharged by the discharge roller 760 (FIG. 11(*c*)).

[C-Fold]

FIG. 12 illustrates an example of a C-fold. FIG. 12 illustrates the folding roller 720, the location determination member 740, the folding blade 750, and the first and second shift members 731 and 732.

Although not illustrated, the location determination member 740 is at the alignment location. The paper P discharged from the printer 100 is fed along the folding path 710. The front end PF of one sheet or multiple sheets of paper P is supported by the location determination member 740 that is at the alignment location, and thus skew may be corrected.

As illustrated in FIG. 12(*a*), the location determination member 740 is moved to a folding location where a ⅓ L point of the paper P is located at the entrance of the folding nip N. Then, the folding blade 750 is moved to the insertion location to push the ⅓ L point of the paper P into the folding nip N (FIG. 12(*b*)). As the paper P passes through the folding nip N, the ⅓ L point of the paper P is folded. The folding blade 750 then returns to the retreat location.

The paper P having passed through the folding nip N is fed along a roller on an opposite side of the front end PF of the paper P from among the first and second rollers 721 and 722, that is, the first roller 721, and is returned to the entrance of the folding nip N. To this end, the first shift member 731 is at the first shift location, and the paper P having passed through the folding nip N is returned to the entrance of the folding nip N along the first guide path 761 (FIGS. 12(*c*) and 12(*d*)).

Although not illustrated, the paper P fed along the folding path 710 in a forward direction is supported by the location determination member 740 that is at the alignment location, and skew is corrected.

The location determination member 740 is moved to the folding location such that a ⅔ L point of the paper P is located at the entrance of the folding nip N (FIG. 12(*e*)). The folding blade 750 is moved to the insertion location, and thus the ⅔ L point of the paper P is pushed into the folding nip N (FIG. 12(*f*)). The first and second shift members 731 and 732 are located at discharge locations. Therefore, the paper P folded in a form of a C is discharged by the discharge roller 760 (FIG. 12(*g*)). The folding blade 750 then returns to the retreat location.

[Double Gate Fold]

FIG. 13 illustrates an example of a double gate fold. FIG. 13 illustrates only the folding roller 720, the location determination member 740, the folding blade 750, and the first and second shift members 731 and 732.

Although not illustrated, the location determination member 740 is located at the alignment location. The paper P discharged from the printer 100 is fed along the folding path 710. The front end PF of one sheet or multiple sheets of paper P is supported by the location determination member 740 that is at the alignment location, and thus skew is corrected.

As illustrated in FIG. 13(*a*), the location determination member 740 is moved to the folding location such that a ¼ L point of the paper P is located at the entrance of the folding nip N. Then, the folding blade 750 is moved to the insertion location to push the ¼ L point of the paper P into the folding nip N (FIG. 13(*b*)). As the paper P passes through the folding nip N, the ¼ L point of the paper P is folded. The folding blade 750 then returns to the retreat location.

The paper P having passed through the folding nip N is fed along a roller on an opposite side of the front end PF of the paper P from among the first and second rollers 721 and 722, that is, the first roller 721, and is returned to the entrance of the folding nip N. To this end, the first shift member 731 is at the first shift location, and the paper P having passed through the folding nip N is returned to the entrance of the folding nip N along the first guide path 761 (FIGS. 13(*c*) and 13(*d*)).

Although not illustrated, the paper P fed along the folding path 710 in a forward direction is supported by the location determination member 740, and thus skew is corrected.

Next, the location determination member 740 is moved to the folding location such that a ¾ L point of the paper P is located at the entrance of the folding nip N (FIG. 13(*e*)). The folding blade 750 is moved to the insertion location, and the ¾ L point of the paper P is pushed into the folding nip N (FIG. 13(*f*)). The folding blade 750 then returns to the retreat location.

The paper P having passed through the folding nip N is fed along a roller on an opposite side of the front end PF of the paper P from among the first and second rollers 721 and 722, that is, the second roller 722, and is returned to the entrance of the folding nip N. To this end, the second shift member 732 is at the second shift location, and the paper P having passed through the folding nip N is returned to the entrance of the folding nip N along the second guide path 762 (FIG. 13(*g*)).

Although not illustrated, the paper P fed along the folding path 710 in a reverse direction is supported by the location determination member 740 that is at the alignment location, and skew is corrected.

The location determination member 740 is moved to the folding location such that a ½ L point of the paper P is located at the entrance of the folding nip N (FIG. 13(*h*)). The folding blade 750 is moved to the insertion location, and thus the ½ L point of the paper P is pushed into the folding nip N (see FIG. 13(*i*). The first and second shift members 731 and 732 are located at discharge locations. Therefore, the paper P folded in a form of a double gate is discharged by the discharge roller 760 (FIG. 13(*j*)). The folding blade 750 then returns to the retreat location.

Other than the above-described folding methods, a 4-fold folding, a Z-fold, a W-fold, a roll fold may be available.

The examples of FIGS. 2 to 10 may be applied to a sheet folding device including two or more folding nips.

FIG. 14 is a schematic structural diagram of a sheet folding device including two folding rollers 720, according to an example. FIG. 14 illustrates a first folding roller 720-1 and a second folding roller 720-2. The first folding roller 720-1 includes the first and second rollers 721 and 722 engaging with each other to form a first folding nip N1. The second folding roller 720-2 includes third and fourth rollers 724 and 725 engaging with each other to form a second folding nip N2. The second folding nip N2 is formed in a direction that is different from a direction in which the first folding nip N1 is formed. A first folding blade 750-1 is moved to an insertion location at which the paper P fed along the folding path 710 is pushed into the first folding nip N1 and to a retreat location retreating from the insertion location. A second folding blade 750-2 is moved to an insertion location at which the paper P having passed through the first folding nip N1 is pushed into the second folding nip N2 and to a retreat location retreating from the insertion location. The location determination member 740 may be moved to an alignment location at which the paper P fed along the folding path 710 is supported and aligned, and to a folding location at which a portion, where a folding line of the paper P is to be formed, is located at an entrance of the first folding nip N1. A structure for moving the first folding blade 750-1 and the second folding blade 750-2 to the insertion location and the retreat location may be the same as the structure described above with reference to FIG. 2. A structure for moving the location determination member 740 to the alignment location and the folding location may be the same as the structure described with reference to FIG. 2.

The guide members 752 and the elastic member 753 which are described above may be applied to at least one of the first folding blade 750-1 and the second folding blade 750-2. The guide members 752 and the elastic member 753 are useful after folding is performed twice, and thus, if the guide members 752 and the elastic member 753 are applied to at least one of the first folding blade 750-1 and the second folding blade 750-2, it may be effective to apply the guide members 752 and the elastic member 753 to the second folding blade 750-2. Also, at least one of rotation linear velocity of the first and second folding rollers 720-1 and 720-2 and movement linear velocity of the first and second folding blades 750-1 and 750-2 may be controlled as described above, depending on the number of sheets of paper P which are folded at the same time. In addition, the insertion locations of the first folding blade 750-1 and the second folding blade 750-2 may be controlled as first and second insertion locations as described above, depending on the number of sheets of paper P which are folded at the same time.

FIG. 15 is a schematic structural diagram of a sheet folding device in which three rollers form two folding nips, according to an example. FIG. 15 illustrates the first folding roller 720-1 and the second folding roller 720-2. The first folding roller 720-1 includes the first and second rollers 721 and 722 engaging with each other to form a first folding nip N1. The second folding roller 720-2 includes a third roller 724 engaging with the second roller 722 to form the second folding nip N2. The second folding nip N2 is formed in a direction that is different from a direction in which the first folding nip N1 is formed. The first folding blade 750-1 is moved to the insertion location at which the paper P fed along the folding path 710 is pushed into the first folding nip N1 and to the retreat location retreating from the insertion location. The second folding blade 750-2 is moved to an insertion location at which the paper P having passed through the first folding nip N1 is pushed into the second folding nip N2 and to the retreat location retreating from the insertion location. The location determination member 740 may be moved to the alignment location at which the paper P fed along the folding path 710 is supported and aligned, and to the folding location at which the portion, where a folding line of the paper P is to be formed, is located at the entrance of the first folding nip N1. The structure for moving the first folding blade 750-1 and the second folding blade 750-2 to the insertion location and the retreat location may be the same as the structure described with reference to FIG. 2. The structure for moving the location determination member 740 to the alignment location and the folding location may be the same as the structure described with reference to FIG. 2.

The guide members 752 and the elastic member 753 which are described above may be applied to at least one of the first folding blade 750-1 and the second folding blade 750-2. The guide members 752 and the elastic member 753 are useful after folding is performed twice, and thus, if the guide members 752 and the elastic member 753 are applied to at least one of the first folding blade 750-1 and the second folding blade 750-2, it may be effective to apply the guide members 752 and the elastic member 753 to the second folding blade 750-2. Also, at least one of the rotation linear velocity of the first and second folding rollers 720-1 and 720-2 and the movement linear velocity of the first and second folding blades 750-1 and 750-2 may be controlled as described above, depending on the number of sheets of paper P which are folded at the same time. In addition, the insertion locations of the first folding blade 750-1 and the second folding blade 750-2 may be controlled as first and second insertion locations as described above, depending on the number of sheets of paper P which are folded at the same time.

It should be understood that examples described herein should be considered in a descriptive sense only and not for purposes of limitation. Descriptions of features or aspects within each example should typically be considered as available for other similar features or aspects in other examples.

While one or more examples have been described with reference to the drawings, it will be understood by those of ordinary skill in the art that various changes in form and details may be made therein without departing from the spirit and scope of the inventive concept as defined by the following claims.

The invention claimed is:

1. A sheet folding device, comprising:

a folding roller comprising at least two rollers that rotate and engage with each other to form a folding nip;

a folding blade movable to an insertion location of the folding nip at which a printing medium on a folding path is to be inserted into the folding nip, and to a retreat location to escape from the folding path; and a guide member including an inclined portion to form an acute angle with the folding blade to press the printing medium at the insertion location of the folding nip towards the folding roller when the folding blade reaches the insertion location of the folding nip, the guide member elastically biased by an elastic member and located at at least one side of the folding blade to move together with the folding blade and to press, by the inclined portion, the printing medium at the insertion location of the folding nip towards the folding roller, when the folding blade reaches the insertion location of the folding nip to insert the printing medium into the folding nip, the elastic member to apply an elastic force to the guide member towards the folding roller to press the printing medium at the insertion location of the folding nip toward the folding roller.

2. The sheet folding device of claim 1, wherein the guide member does not contact the folding roller when the folding blade reaches the insertion location.

3. The sheet folding device of claim 1, wherein the insertion location of the folding nip comprises:

a first insertion location where the folding blade is not inserted into the folding nip; and a second insertion location where the folding blade is inserted into the folding nip.

4. The sheet folding device of claim 3, wherein when the folding blade is moved to the first insertion location, the printing medium pushed by the folding blade is inserted into the folding nip due to friction with the folding roller.

5. The sheet folding device of claim 3, further comprising:

a first motor to drive the folding blade; and a controller to drive the first motor to move the folding blade to the first insertion location when a single printing medium is to be folded, and to move the folding blade to the second insertion location when a plurality of printing media are to be folded.

6. The sheet folding device of claim 1, further comprising:

a first motor to drive the folding blade; and a second motor to drive the folding roller; and a controller to control the first motor and the second motor such that a movement linear velocity of the folding blade is greater than a rotation linear velocity of the folding roller when a plurality of printing media are to be folded, and such that the movement linear velocity of the folding blade is less than the rotation linear velocity of the folding roller when a single printing medium is to be folded.

7. The sheet folding device of claim 1, further comprising:

a location determination member to be moved to an alignment location to align the printing medium by supporting an end portion of the printing medium on the folding path, and to a folding location to match a folding line location of the printing medium with a location corresponding to the folding nip.

8. The sheet folding device of claim 1, further comprising:

a guide path to return the printing medium, which has passed through the folding nip, to the folding path and provided around at least one of the at least two rollers; and a shift member, disposed at an exit of the folding nip, to selectively guide the paper to the guide path.

9. The sheet folding device of claim 8, wherein the at least two rollers comprises a first roller and a second roller, the guide path comprises a first guide path provided around the first roller, and a second guide path provided around the second roller, and the shift member comprises a first shift member to selectively guide the printing medium having passed through the folding nip to the first guide path, and a second shift member to selectively guide the printing medium having passed through the folding nip to the second guide path.

10. The sheet folding device of claim 1, wherein the folding roller comprises a first folding roller to form a first folding nip, and a second folding roller to form a second folding nip in a direction that is different from a direction in which the first folding nip is formed, the folding blade comprises a first folding blade to push the printing medium on the folding path into the first folding nip, and a second folding blade to push the printing medium that passes through the first folding nip into the second folding nip, the guide member includes a first guide member located at at least one side of the first folding blade and/or a second guide member located at at least one side of the second folding blade, and the elastic member includes a first elastic member to apply the elastic force to the first guide member and/or a second elastic member to apply the elastic force to the second guide member.

11. The sheet folding device of claim 10, wherein the guide member includes the first guide member and the second guide member and the elastic member includes the first elastic member and the second elastic member.

12. The sheet folding device of claim 1, wherein the at least two rollers comprises first and second rollers engaging with each other to form a first folding nip, and a third roller engaging with the second roller to form a second folding nip in a direction that is different from a direction in which the first folding nip is formed, the folding blade comprises a first folding blade to push the printing medium on the folding path into the first folding nip, and a second folding blade to push the printing medium that passes through the first folding nip into the second folding nip, the guide member includes a first guide member located at at least one side of the first folding blade and/or a second guide member located at at least one side of the second folding blade, and the elastic member includes a first elastic member to apply the elastic force to the first guide member and/or a second elastic member to apply the elastic force to the second guide member.

13. An image forming apparatus, comprising:

a printer to form an image on a printing medium; and a finisher to perform, after the image is formed on the printing medium, at least one of a stapling operation, an alignment operation, or a folding operation, the finisher including a sheet folding device which includes:

a folding roller comprising at least two rollers that rotate and engage with each other to form a folding nip, a folding blade movable to an insertion location of the folding nip at which the printing medium, disposed on a folding path, is to be inserted into the folding nip, and to a retreat location to escape from the folding path, and a guide member including an inclined portion to form an acute angle with the folding blade to press the printing medium at the insertion location of the folding nip towards the folding roller when the folding blade reaches the insertion location of the folding nip, the guide member elastically biased by an elastic member and located at at least one side of the folding blade to move together with the folding blade and to press, by the inclined portion, the printing medium at the insertion location of the folding nip towards the folding roller, when the folding blade reaches the insertion location of the folding nip to insert the printing medium into the folding nip, the elastic member to apply an elastic force to the guide member towards the folding roller to press the printing medium at the insertion location of the folding nip toward the folding roller.

* * * * *